United States Patent [19]

Tuttle

[11] 4,342,611

[45] Aug. 3, 1982

[54] METHODS OF PRODUCING STAINED GLASS EFFECTS

[76] Inventor: Helen K. Tuttle, 200 Gay Rd., North East, Pa. 16428

[21] Appl. No.: 226,501

[22] Filed: Jan. 19, 1981

[51] Int. Cl.[3] ..... B44F 1/06; B44F 3/00

[52] U.S. Cl. ..... 156/63; 428/38; 434/83

[58] Field of Search ..... 52/311; 156/63; 428/38, 428/39; 434/83

[56] References Cited

U.S. PATENT DOCUMENTS

| | | | |
|---|---|---|---|
| 2,148,632 | 2/1939 | Lovejoy | 434/83 |
| 3,420,728 | 1/1969 | Haverstock | 156/63 X |
| 3,420,730 | 1/1969 | Ellefson | 428/38 |
| 3,451,879 | 6/1969 | Fuller | 156/63 X |
| 4,083,740 | 4/1978 | Hamanaka | 428/40 X |
| 4,163,813 | 8/1979 | Sheets et al. | 428/155 X |
| 4,217,378 | 8/1980 | Pizur, Sr. | 156/82 X |

*Primary Examiner*—Henry F. Epstein

*Attorney, Agent, or Firm*—Buell, Blenko, Ziesenheim & Beck

[57] ABSTRACT

A method of producing stained glass effects and objects produced thereby are provided wherein a clear glass or plastic object has adhered on one surface a string outline of art work being produced and colored stain within areas defined by said string to produce a multicolored art work product.

7 Claims, 2 Drawing Figures

METHODS OF PRODUCING STAINED GLASS EFFECTS

This invention relates to methods of producing stained glass effects and objects produced thereby and particularly to a clear glass having outlined thereon in adhered string, art work which is stained in the areas defined by said string.

The beauty of stained glass work is so well known that it requires no description here. Equally well known, however, is the difficulty in making stained glass art work by the conventional practice of cutting colored glass pieces and assembling the same with lead and solder connections. Various techniques have been proposed for simulating this technique including cutting and assembling colored plastic film on a glass substrate and similar practices. These practices also require some considerable skill both in cutting and assembling and in handling adhesives.

I have invented a technique for craft projects which produces a unique effect similar to that of stained glass without the cutting and assembling associated with stained glass or even that associated with cutting and assembling plastic film. The technique of my invention is simple, inexpensive and can be practiced by children as well as adults to produce objects of great beauty.

In the practice of my invention I follow the steps of either placing a sheet of clear glass or a glass object, or a clear plastic sheet or object over an art work to be copied, moistening one edge of a length of glue impregnated dry thread or string, placing the moistened edge of the string around the outlines of the art work visible through the glass so that each color area is defined by a surrounding fence of string or thread adhered to the glass, placing a colored stain in each such defined area to provide the necessary color in the area defined by the string or thread, permitting the stain to dry and removing the glass from the art work or of following the same steps but using original art work without copying. Preferably, the stain is a translucent stain. The string or thread may be pre-dried or colored and is preferably precoated or impregnated with a water soluble, clear drying glue and dried prior to use. The glue impregnating string is preferably cut to length as the art work is copied and moistened along one side with a small brush prior to application to the glass. Preferably, the string is coated with a clear stain before applying the colored stain so as to waterproof it and prevent colored stain from being absorbed by the string. The completed glass or plastic art work is preferably mounted on a white background or hung in a window to permit light to pass through.

Figure 1:
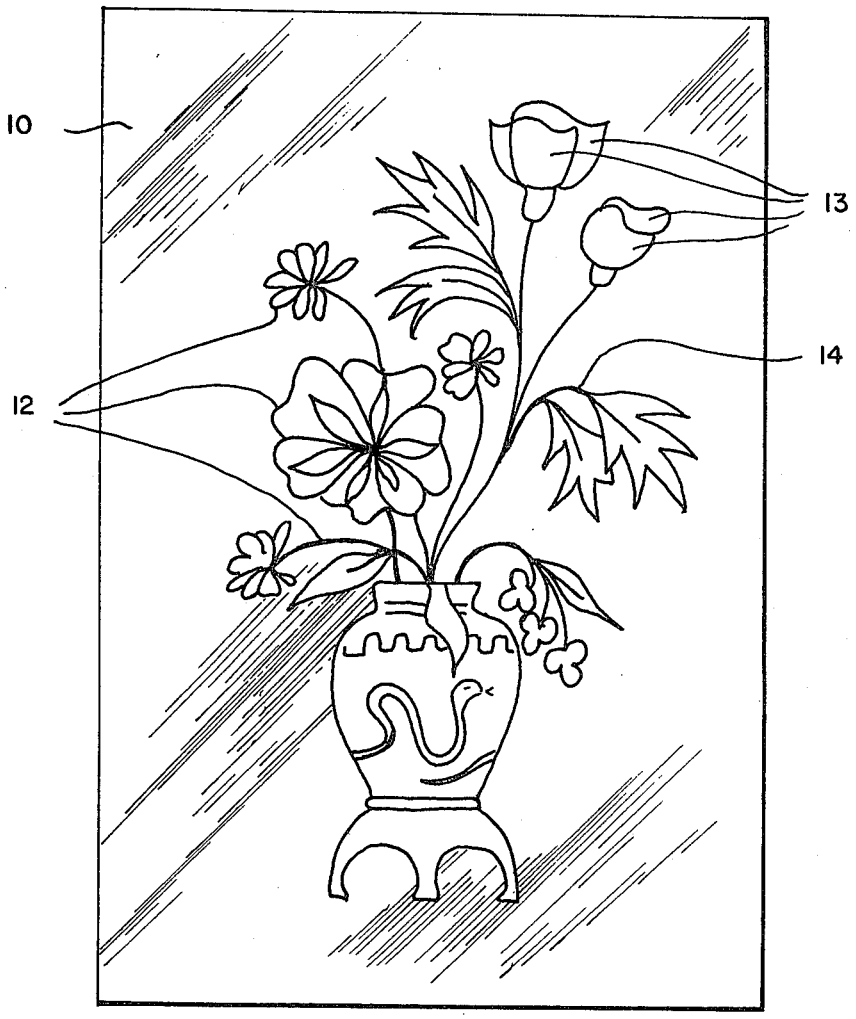
Figure 2:
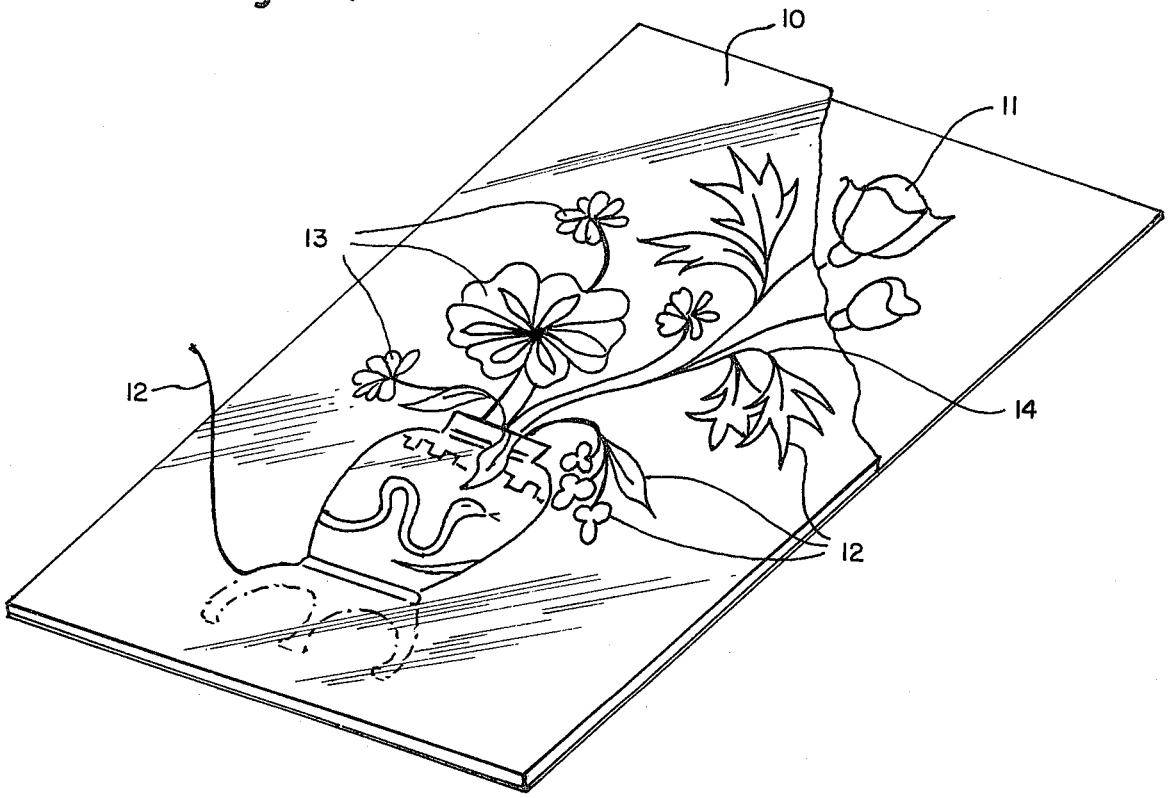

In the foregoing general description I have set out certain objects, purposes and advantages of my invention. Other objects, purposes and advantages of this invention will be apparent from a consideration of the following description and accompanying drawings in which:

FIG. 1 is a plan view of a completed stained glass effect object according to my invention, and FIG. 2 is an isometric view of the stained glass effect object of FIG. 1 partially assembled.

Referring to the drawings and particularly to FIG. 2, I practice my invention by placing a sheet clear glass or plastic 10, cut to the desired size, over a piece of art work 11 to be copied. The art work 11 is clearly visible through the glass 10. I next cut segments of dry glue impregnated string 12 to the proper lengths to follow the outlines of the several colored areas 13 of the art work. Each string segment 12 is moistened along one edge with water applied by a brush and the moistened edge pressed onto the glass following the outline of a colored area. In the case of a line or a flower or leaf stem 14 the string 12 is preferably predried or colored with the desired color. Where it is desired to accent the outline, the string or thread may be predried or colored. After the string 12 is in place defining a colored area 13, a colored stain of the desired color is placed in the area and flowed thereover until it contacts the string and forms a meniscus between the string and glass, coloring the string and waterproofing the string and joining area to protect the same from moisture. Preferably, however, I use colored string and coat the same with clear strain after the strings are in place and dried so as to waterproof the same and prevent absorption of colored stain.

After the stain has dried in all areas, the glass 10 is removed from the art work 11 and either hung over a window to permit light to pass through or placed over a white background sheet to provide reflected light through the art work.

The same practice can be used on vases and similar non-flat glass or plastic objects.

In the foregoing specification I have set out certain practices and embodiments of this invention, however it will be understood that this invention may be otherwise embodied and practiced within the scope of the following claims.

I claim:

1. A method producing stained glass effect art work comprising the steps of:

a. moistening at least one edge of a length of glue impregnated string;

b. placing the moistened edge of said glue impregnated string on one of a glass and plastic object to permanently fix the string in place and to define the outlines of art work to be produced so that at least each different color area is defined by a surrounding adhered fence of string on said object;

c. placing a liquid colored stain in each said defined area to provide the desired color in each area defined by said string fence; and d. permitting the stain to dry.

2. A method as claimed in claim 1 wherein the string defining each colored area is pre-colored to match said area.

3. A method as claimed in claim 1 wherein the stain is a translucent stain.

4. A method as claimed in claim 1 wherein the string is impregnated with a clear, water soluble adhesive and dried prior to use.

5. A method as claimed in claim 1 wherein the string is pre-colored and is coated after being adhered to the glass and prior to applying a liquid colored stain with a clear waterproof stain.

6. A method as claimed in claims 1, 2, 3, 4 or 5 wherein the object is a piece of flat glass which is first placed over an art work to be reproduced and the moistened string is applied to the glass around the outlines of the art work visible through the glass.

7. A method as claimed in claims 1, 2, 3, 4 or 5 wherein the object is a piece of flat plastic which is first placed over an art work to be reproduced and the moistened string is applied to the plastic around the outlines of the art work visible through the plastic.

* * * * *

UNITED STATES PATENT AND TRADEMARK OFFICE

CERTIFICATE OF CORRECTION

PATENT NO. : 4,342,611

DATED : August 3, 1982

INVENTOR(S) : HELEN K. TUTTLE

It is certified that error appears in the above-identified patent and that said Letters Patent are hereby corrected as shown below:

Column 1, line 64, after "sheet", --of-- should be inserted.

Column 2, line 16, "strain" should read --stain--.

Signed and Sealed this

*Twelfth* Day of *October 1982*

[SEAL]

*Attest:*

GERALD J. MOSSINGHOFF

*Attesting Officer*

*Commissioner of Patents and Trademarks*